US006276187B1

(12) United States Patent
Hutchinson

(10) Patent No.: US 6,276,187 B1
(45) Date of Patent: Aug. 21, 2001

(54) HYDRA CLAMP

(76) Inventor: Timothy A. Hutchinson, 156 Maple La., Dresden, TN (US) 38225

( * ) Notice: Subject to any disclaimer, the term of this patent is extended or adjusted under 35 U.S.C. 154(b) by 0 days.

(21) Appl. No.: 09/140,989

(22) Filed: Aug. 27, 1998

(51) Int. Cl.[7] ..... B21J 13/08

(52) U.S. Cl. ..... 72/457; 72/300; 72/305; 72/311; 72/705

(58) Field of Search ..... 269/25, 32, 59; 72/705, 305, 457, 295, 372, 300, 311

(56) References Cited

U.S. PATENT DOCUMENTS 3,458,182 * 7/1969 Flachbarth et al. ..... 269/25
4,251,065 * 2/1981 McDougal ..... 269/25
5,054,307 * 10/1991 Wisner ..... 72/457
5,163,663 * 11/1992 Harris ..... 269/210
5,623,846 * 4/1997 Brewer, Jr. ..... 72/705

OTHER PUBLICATIONS

A brochure entitled, "The Enforcer Series," by Car–Clamp Inc., 1999.

* cited by examiner

*Primary Examiner*—Ed Tolan
(74) *Attorney, Agent, or Firm*—Price and Gess

(57) ABSTRACT

A clamping device including a housing having a base portion slideably mounted to be positionable along the width of a carriage, the carriage being slideably mounted to be positionable along the length of a guide track. The housing includes a clamping jaw pivotally mounted therein and activatable by a hydraulic cylinder. The carriage is designed to interlock with the base portion of the housing and with the guide track upon activation of the hydraulic cylinder.

28 Claims, 4 Drawing Sheets

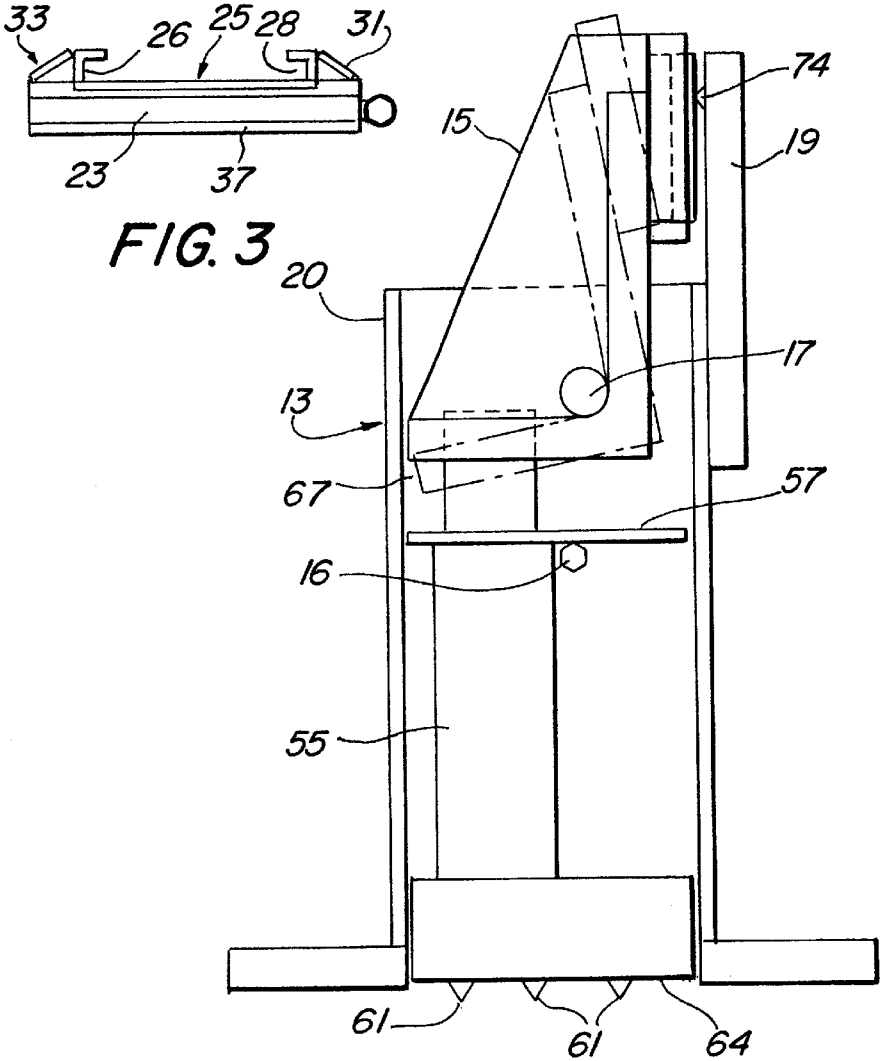
FIG. 3
FIG. 6
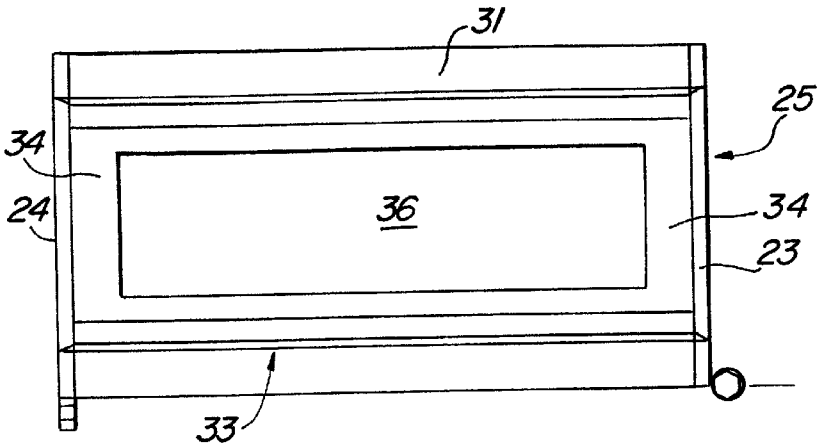
FIG. 4
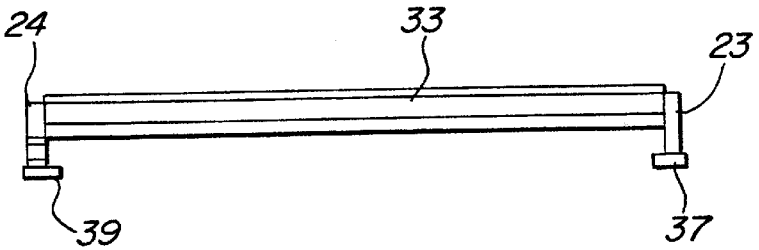
FIG. 5

HYDRA CLAMP

BACKGROUND OF THE INVENTION

1. Field of the Invention

The subject invention relates generally to vehicles and more particularly an improved clamping device for vehicle repair systems, such as so-called "frame machines."

2. Description of Related Art

Vehicle repair apparatus sometimes known as frame machine are known in the prior art. Such devices have employed mechanical clamps which attach to the sides of vehicle frames, typically by bolting thereto. Such clamping mechanisms have proved relatively cumbersome in use and far less than universal in application.

SUMMARY OF THE INVENTION

The subject invention provides a hydraulically activated clamping device positionable along the length and width of the horizontal guide track or rail of a vehicle repair apparatus. A single hydraulic cylinder activates the clamp jaw and simultaneously causes the locking of clamping device in position with respect to the guide track.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein:

FIG. 3 is a side view of a carriage component according to the preferred embodiment.

FIG. 4 is a top view of the carriage component of FIG. 3.

FIG. 5 is an end view of the carriage component of FIG. 3.

FIG. 6 is a side sectional view taken at 6—6 of FIG. 1 illustrating housing and clamping apparatus according to the preferred embodiment.

DETAILED DESCRIPTION OF THE PREFERRED EMBODIMENTS

Figure 1:
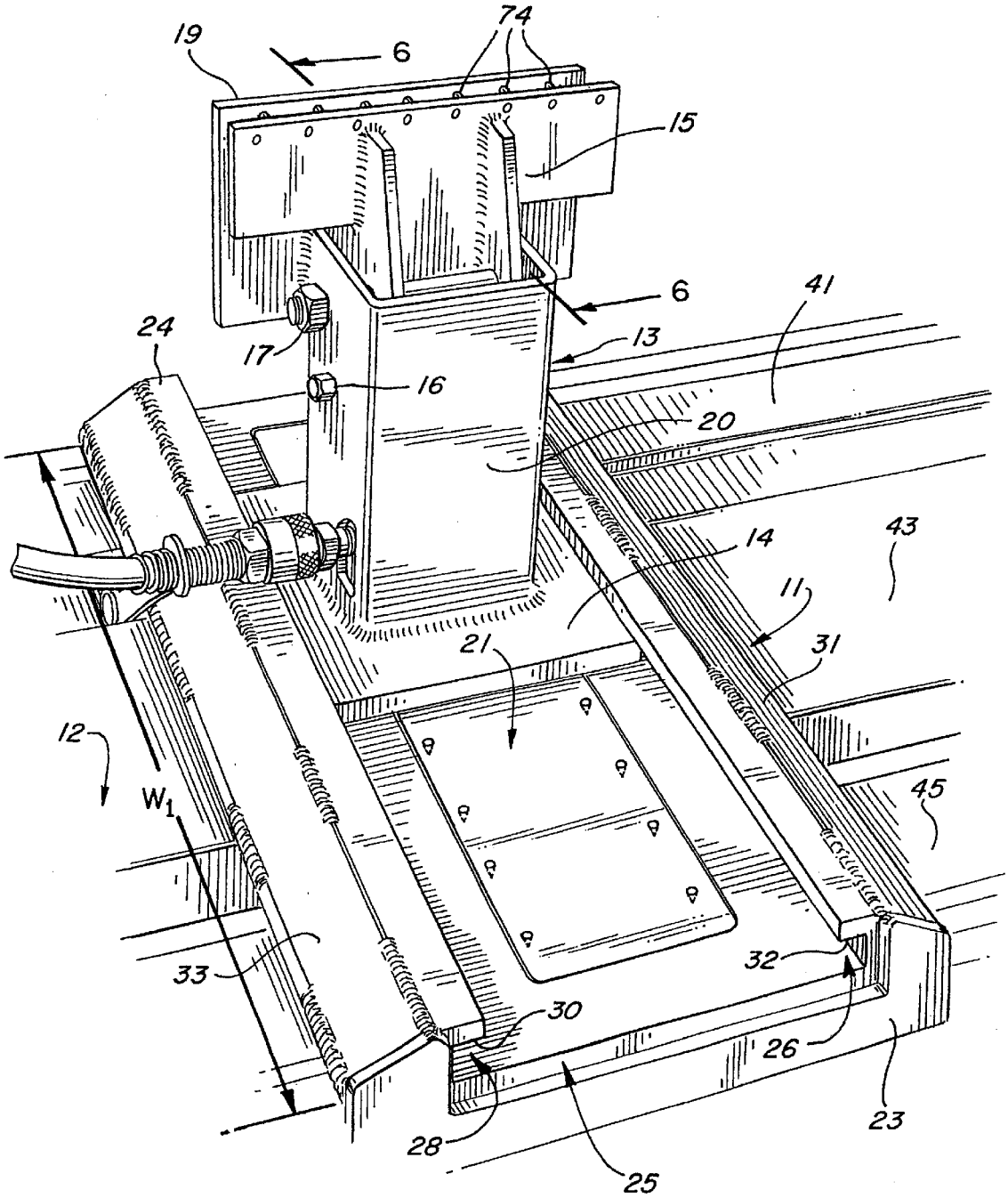
FIG. 1 is a perspective view of a hydraulic clamping mechanism according to the preferred embodiment of the invention.
Figure 2:
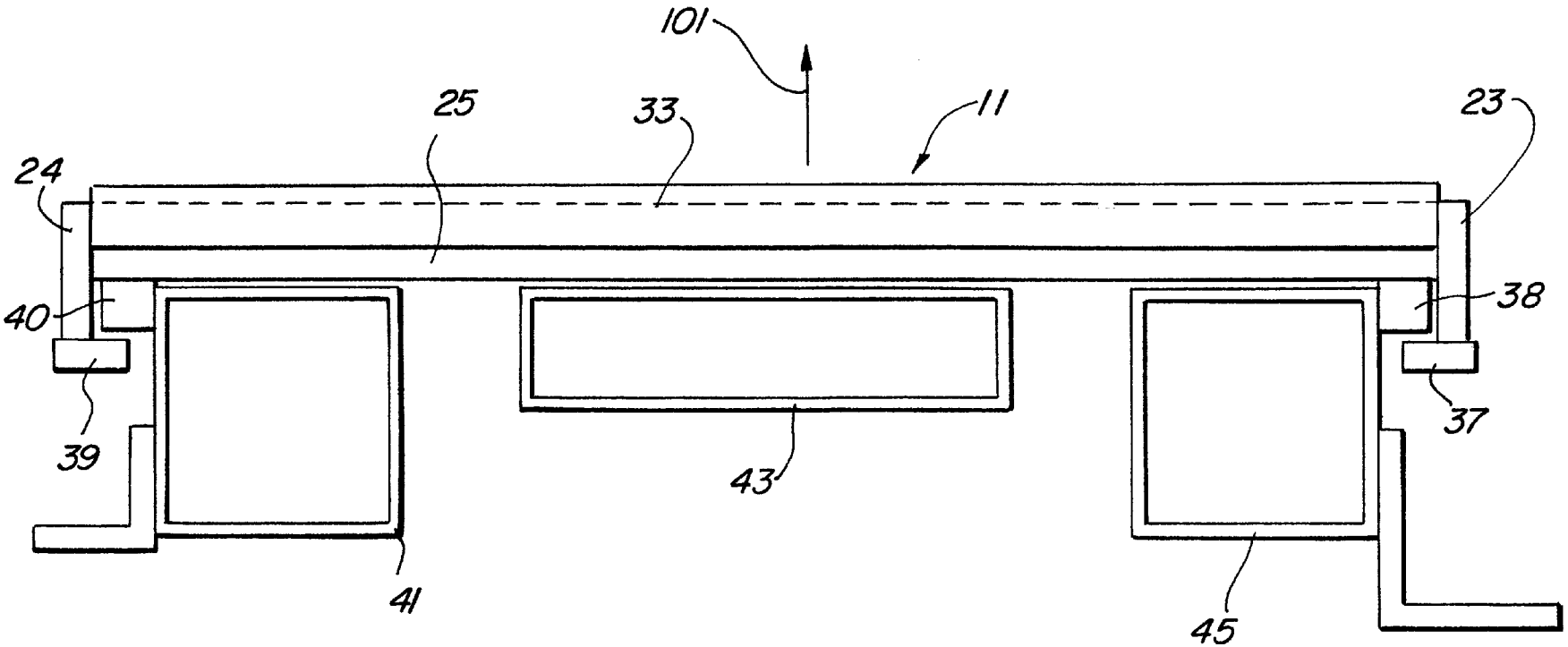
FIG. 2 is an end view of a portion of the mechanism of FIG. 1.
Figure 10:
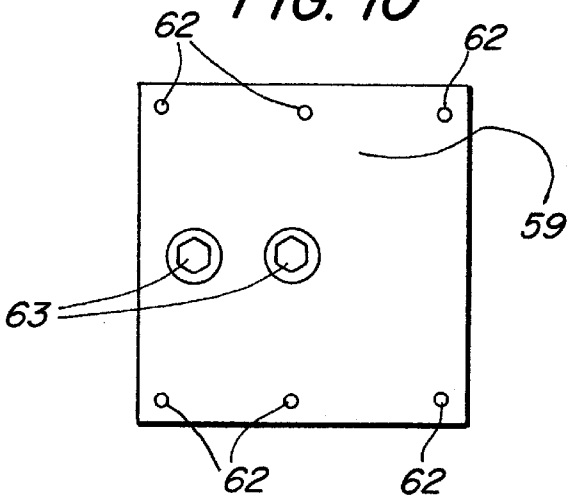
FIG. 10 is a top view of a cylinder mounting plate according to the preferred embodiment.

Clamping apparatus according to the preferred embodiment is illustrated in FIG. 1. The mechanism includes a carriage 11 mounted to move up and down along the length of a track 12. A housing assembly 13 is positioned within the carriage 11 and includes a rectangular base plate 14 to which is welded an upright hollow channel member or tube 20 of square cross section. The housing assembly 13 pivotally mounts a clamp shoe 15 to pivot toward and away from a fixed plate 19. The clamp shoe 15 and fixed plate 19 form jaws for grasping the pinch weld of a vehicle when the clamping apparatus is activated. Further illustrated in FIG. 1 is a hydraulic hose and coupling 21 which supplies fluid under pressure to a five ton hydraulic cylinder mounted within the housing assembly 13.

The carriage 11 as further illustrated in FIGS. 2 through 5 and includes a central channel member 25 providing guides 26, 28 of u-shaped cross section at opposite ends thereof. These guides 26, 28 permit the base plate 14 of the housing assembly 13 to slide to any position along the width "$W_1$" of the carriage 11 when the hydraulic cylinder located within the housing assembly 13 is not activated. The base plate 14 is of a sufficient width $W_2$ that it cannot be pulled vertically out of its position located within guides 26, 28; in other words, if the base plate 14 moves up vertically it will abut and interlock with the upper horizontal edges 30,32 of the respective guide channels 26, 28. Rectangular bars 31, 33 are welded on either side of the channel 25 so as to provide additional support to the channel guide structures 26, 28.

The base surface 34 of the channel 25 has a rectangular central opening 36 therein which receives a rectangular plate or insert piece 21. A series of holes drilled along opposite edges of the plate 21 are visible in FIG. 1. These holes provided for the insertion of teeth (shown in phantom) on the underside of plate 21 which function to bite into the rails 41, 43, 45 of the track 12 when the hydraulic cylinder located within the housing assembly 13 is activated as described in further detail below. The plate 21 is therefore not attached in any fashion to the surrounding channel 25, but rather simply loosely rests in the opening 36.

An end-plate 23 is welded to the end of the channel 25. As seen particularly in FIG. 2, a second end-plate 24 is welded to the opposite end of the channel 25. Lips 37, 39 are welded at the respective lower ends of the end-plates 23, 24 and extend inwardly towards the two square rails 41, 45 a sufficient distance such that vertical movement of the carriage member 11 in direction of the arrow 101 will cause the lips 37, 39 to engage respective rods 38, 40, which may be for example 7/8 inch square steel rods running the length of the track 12.

Apparatus located within the interior of the housing assembly 13 is illustrated in FIG. 6. As there shown, a hydraulic cylinder 55 is attached to a cylinder mounting plate 59. As illustrated in FIG. 11, this mounting is achieved via bolts or other suitable fasteners inserted through respective holes 63 in the cylinder mounting plate 59. Holes 62 are drilled along opposite edges of the cylinder mounting plate 59 such that teeth 61 may be inserted or otherwise attached on the underside 64 thereof. The cylinder mounting plate 59 is slideably mounted such that it may move up and down within the upright tube 20 of the housing assembly 13. The extent of such movement may be, for example, one inch.

The piston of the hydraulic cylinder 55 is connected to activate a plate 57 so as to move plate 57 toward and away from contact with the base 67 of the clamping shoe 15. A bolt 16 extends from one side face of the upright tube 20 through the opposite side face and limits the lower range of travel of the plate 57.

Figure 7:
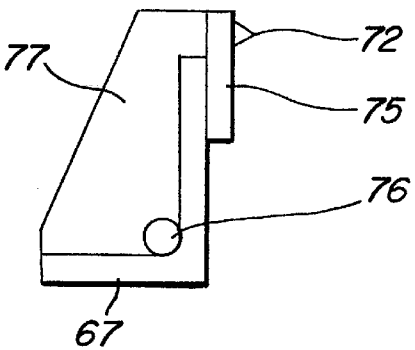
FIG. 7 is a side view of the clamp shoe according to the preferred embodiment.
Figure 9:
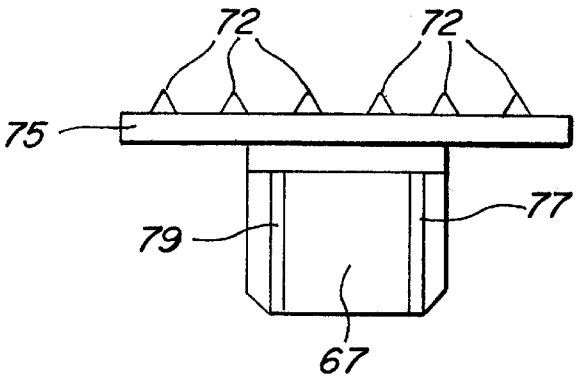
FIG. 9 is a top view of the clamp shoe of FIG. 8.
Figure 8:
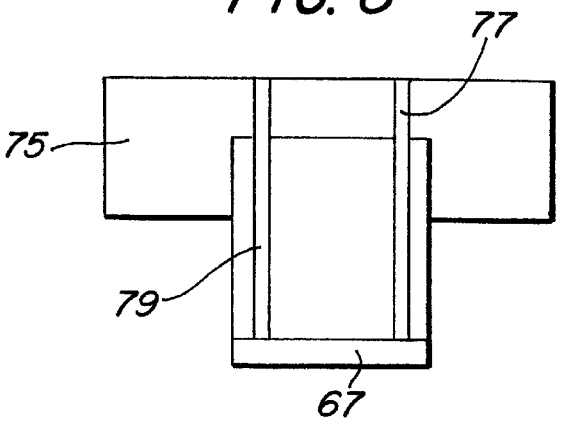
FIG. 8 is a back view of the clamp shoe of FIG. 8.

The clamping shoe 15 is illustrated in further detail in FIGS. 7 through 9. The clamp shoe 15 includes the base member 67 and a vertical plate 75. To each of these plates 67, 75 are welded parallel rear support plates 77, 79. A horizontal row of teeth 72 is also provided on the front or gripping face of the vertical plate 75. Similarly, a horizontal row of gripping teeth 74 is provided on the interior surface of the fixed rear plate 19, which plate 19 is welded to the rear wall 51 of the upright tube 20. The clamping plate 15 is further provided with a bore 76 for accommodating the bolt 17 about which the clamping plate 15 pivots.

In operation of the preferred embodiment, the carriage 11 is moved to an appropriate position along the length of the guide track 12, and the housing assembly is moved into position such that the jaws formed by the clamp shoe 15 and the fixed plate 19 are open and disposed about the pinch weld of an automobile or other vehicle to be repaired. The hydraulic cylinder 55 is then activated, forcing the upper plate 57 upward thereby pivoting the clamping jaw 15 into a position where it tightly clamps the pinch weld. At the same time, the cylinder mounting plate 64 is forced downward against the insert piece 21, which in turn forces the base plate 14 up into interlocking relation with the upper edges of 30,32 of the guide channels 26, 28 and forces the carriage lips 37, 39 up into contact with the rods 38, 40. Simultaneously, the teeth 61 of the cylinder mounting plate 64 bite into the insert piece 21 whose teeth in turn bite into the underlying guide track member 41, 43, 45. In this manner, the entire assembly is fixed in position as long as the hydraulic pressure is present. In particular, the housing assembly 13 is fixed in position such that it cannot move along the guide rails 26, 28, while the carriage 11 is fixed to the guide track 11 such that it cannot move along the length thereof.

It may be noted that apparatus according to the invention may be configured without employing teeth such as 64 and 21. However, such apparatus is likely to be less secure than that constructed according to the preferred embodiment.

Those skilled in the art will appreciate that various other adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. Clamping apparatus comprising:

an upright housing containing a hydraulic cylinder and having a base portion attached thereto at a lower end thereof, the base portion being slideably mounted to a carriage such that said base portion is positionable along a width of the carriage, said width lying along a first axis, the carriage being slideably mounted to an underlying guide track so as to be slideably positionable along a length of the guide track, said length lying along a second axis perpendicular to said first axis;

a clamping jaw pivotally mounted in said housing;

said hydraulic cylinder being located beneath said clamping jaw, said cylinder being mounted to a mounting plate, said mounting plate lying within said housing and being slideably mounted to move vertically with respect to said housing; and an insert piece located in an opening in said carriage, said insert piece having an upper surface positioned beneath said mounting plate, said insert piece further having an under surface thereof positioned adjacent said guide track.

2. The apparatus of claim 1 wherein said mounting plate has a plurality of gripping teeth mounted on an undersurface thereof and wherein a plurality of gripping teeth are further mounted on the undersurface of said insert piece.

3. The apparatus of claim 1 further including a plate positioned between said hydraulic cylinder and said clamping jaw.

4. The apparatus of claim 3 further including a fixed plate attached to said housing and disposed opposite said clamping jaw.

5. The apparatus of claim 1 wherein said carriage includes first and second lips on opposite ends thereof, each lip extending inwardly beneath said guide track.

6. The apparatus of claim 1 wherein said carriage further includes first and second oppositely disposed guides, said guides including first and second upper horizontal surfaces disposed above opposite sides of said base.

7. The apparatus of claim 4 wherein said carriage includes first and second lips on opposite ends thereof, each lip extending inwardly beneath said guide track.

8. The apparatus of claim 7 wherein said carriage further includes first and second oppositely disposed guides, said guides including first and second upper horizontal surfaces disposed above opposite sides of said base.

9. Clamping apparatus comprising:

a vertically disposed housing having an upper end and a lower end, said housing further having a flat base attached at said lower end;

a clamping jaw pivotally mounted at the upper end of said housing;

carriage means for slideably mounting the base of said housing to slide along a width of said carriage means, said carriage means including means for interlocking with said base upon upward movement of said base and means for interlocking with a guide track disposed beneath said carriage means; and means including a hydraulic cylinder for simultaneously (a) pivoting said clamping jaw into clamping position, (b) causing the base of said housing means to interlock with said carriage means, and (c) causing said carriage means to interlock with said guide track.

10. The clamping apparatus of claim 9 wherein said means including a hydraulic cylinder further comprises a mounting plate attached to a bottom surface of said hydraulic cylinder, said mounting plate being slideably mounted with respect to said housing and disposed opposite said insert.

11. The apparatus of claim 10 wherein said mounting plate has a plurality of gripping teeth mounted on an undersurface thereof and wherein a plurality of gripping teeth are further mounted on an undersurface of said insert piece.

12. The apparatus of claim 11 further including a plate positioned between said hydraulic cylinder and said clamping jaw.

13. The apparatus of claim 12 further including a fixed plate attached to said housing and disposed opposite said clamping jaw.

14. The apparatus of claim 7 wherein said means including a hydraulic cylinder which includes first and second lips formed on opposite ends of said carriage means, each lip extending inwardly beneath said guide track.

15. The apparatus of claim 14 wherein said means including a hydraulic cylinder further includes first and second oppositely disposed guides, said guides including first and second upper horizontal surfaces disposed above opposite sides of said base.

16. The apparatus of claim 13 wherein said means including a hydraulic cylinder includes first and second lips formed on opposite ends of said carriage means, each lip extending inwardly beneath said guide track.

17. The apparatus of claim 16 wherein said means including a first hydraulic cylinder further includes first and second oppositely disposed guides, said guides including first and second upper horizontal surfaces disposed above opposite sides of said base.

18. The apparatus of claim 9 wherein said hydraulic cylinder is the only hydraulic cylinder employed in said apparatus to cause the pivoting of said clamping jaw, the interlocking of said base with said carriage means, and the interlocking of said carriage means with said guide track.

19. A clamping method comprising the steps of:

activating a clamping jaw of a clamping device of a vehicle repair system with a hydraulic cylinder; and employing the same hydraulic cylinder to activate a mechanism for holding the clamping device in position with respect to a vehicle under repair.

20. The method of claim 19 wherein activation of said clamping jaw by said hydraulic cylinder causes said clamping jaw and a cooperating jaw to fixedly grasp a portion of a vehicle under repair.

21. Clamping apparatus for vehicle repair comprising:

a vertically disposed housing having an upper end and a lower end, said housing further having a flat base attached at said lower end;

a clamping jaw pivotally mounted at the upper end of said housing;

carriage means for slideably mounting the base of said housing to slide along a width of said carriage means toward and away from a side of a vehicle under repair, said carriage means including means for interlocking with said base upon upward movement of said base and means for interlocking with a guide track, said guide track being disposed beneath said carriage means and along the length of said vehicle; and means including a hydraulic cylinder for simultaneously (a) pivoting said clamping jaw into clamping position, (b) causing the base of said housing means to interlock with said carriage means, and (c) causing said carriage means to interlock with said guide track.

22. The apparatus of claim 21 wherein said carriage means further includes an opening and an insert piece resting in said opening and positioned to lie beneath said housing and adjacent said guide track.

23. The clamping apparatus of claim 22 wherein said means including a hydraulic cylinder further comprises a mounting plate attached to a bottom surface of said hydraulic cylinder, said mounting plate being slideably mounted with respect to said housing and disposed opposite said insert.

24. The apparatus of claim 23 wherein said mounting plate has a plurality of gripping teeth mounted on an undersurface thereof and wherein a plurality of gripping teeth are further mounted on an undersurface of said insert piece.

25. The apparatus of claim 21 wherein said means including a hydraulic cylinder includes first and second lips formed on opposite ends of said carriage means, each lip extending inwardly beneath said guide track.

26. The apparatus of claim 25 wherein said means including a hydraulic cylinder further includes first and second oppositely disposed guides, said guides including first and second upper horizontal surfaces disposed above opposite sides of said base.

27. The apparatus of claim 21 wherein said hydraulic cylinder is the only hydraulic cylinder employed in said clamping apparatus to cause the pivoting of said clamping jaw, the interlocking of said base with said carriage means, and the interlocking of said carriage means with said guide track.

28. Clamping apparatus comprising:

an upright housing containing a hydraulic cylinder, said housing having a rectangular base portion attached thereto at a lower end thereof;

a clamping jaw pivotally mounted in said housing;

said hydraulic cylinder being located beneath said clamping jaw and mounted to a mounting plate, said mounting plate lying within said housing and being slideably mounted to move up and down with respect to said housing;

a carriage having a rectangular bed and first and second channels on opposite sides of said bed, said channels cooperating to mount said base so as to slide with respect to said rectangular bed while limiting the extent of upward travel of said base with respect to said carriage, said carriage having an opening therein disposed to lie beneath said mounting plate;

a guide track located beneath said carriage and slideably mounting said carriage such that said carriage is slideably positionable along a length of said guide track; and an insert piece located in said opening in said carriage and moveable vertically with respect to said carriage, said insert piece having an upper surface positioned beneath said mounting plate, said insert piece further having an under surface thereof positioned adjacent said guide track.

* * * * *